United States Patent [19]

Sakai

[11] Patent Number: 4,758,107

[45] Date of Patent: Jul. 19, 1988

[54] WEB FEED TRACTOR FOR PRINTER

[75] Inventor: Tetsuo Sakai, Fukui, Japan

[73] Assignee: Sakase Kagaku Kogyo Kabushiki Kaisha, Fukui, Japan

[21] Appl. No.: 854,162

[22] Filed: Apr. 21, 1986

[51] Int. Cl.[4] ..... B41J 11/30; B41J 11/39

[52] U.S. Cl. ..... 400/616.2; 226/76; 226/86; 226/196

[58] Field of Search ..... 400/611, 616, 616.1, 400/616.2, 618; 226/74, 75, 76, 86, 170, 171, 172, 173, 196, 199

[56] References Cited

U.S. PATENT DOCUMENTS

| | | | |
|---|---|---|---|
| 3,159,263 | 12/1964 | Goreham | 400/616.2 X |
| 3,283,875 | 11/1966 | Davies | 400/616.2 X |
| 3,669,327 | 6/1972 | Dowd | 400/616.2 X |
| 3,917,048 | 11/1975 | Riley | 400/616.2 X |
| 3,958,735 | 5/1976 | Wanat | 400/616.2 X |
| 4,111,565 | 9/1978 | Jagger | 400/616.2 X |
| 4,115,014 | 9/1978 | Wood et al. | 400/611 |
| 4,199,091 | 4/1980 | Hubbard | 226/170 |
| 4,344,715 | 9/1982 | Van Horne et al. | 400/616.1 |
| 4,365,905 | 12/1982 | Jung | 400/616.1 X |
| 4,519,723 | 5/1985 | Kusmierz | 226/74 |
| 4,569,468 | 2/1986 | Neer | 400/616.1 X |
| 4,572,418 | 2/1986 | Hirata | 400/616.2 X |
| 4,614,287 | 9/1986 | Ueno et al. | 400/616.1 X |
| 4,638,935 | 1/1987 | Wald | 226/171 |
| 4,642,661 | 2/1987 | Dean | 400/616.2 X |
| 4,650,358 | 3/1987 | Lohrmann et al. | 400/616.2 |
| 4,652,160 | 3/1987 | Lohrmann | 400/616.2 |

FOREIGN PATENT DOCUMENTS

| | | | |
|---|---|---|---|
| 50718 | 5/1982 | European Pat. Off. | 400/616.1 |
| 2827125 | 1/1980 | Fed. Rep. of Germany | 400/616.2 |
| 2043 | 1/1980 | Japan | 400/616.2 |
| 161680 | 12/1980 | Japan | 400/616 |
| 96880 | 6/1982 | Japan | 400/618 |
| 67486 | 4/1983 | Japan | 400/616.2 |
| 76373 | 4/1985 | Japan | 400/616.1 |
| 198275 | 10/1985 | Japan | 400/616.1 |
| 85/03671 | 8/1985 | World Int. Prop. O. | 400/616.2 |
| 1337472 | 11/1973 | United Kingdom | 226/74 |

OTHER PUBLICATIONS

IBM Tech. Disc. Bulletin, "Tractor Clamp Device Cam Lock", Williams, vol. 19, No. 11, Apr. 1977, p. 4114.

IBM Tech. Disc. Bulletin, "Anti-Backlash Spring Clamp", Cornell, vol. 22, No. 5, Oct. 1979, p. 1788.

Research Disclosure, "Continuous Form Pin-Feed Tractor Exit Ramp", Kenneth Mason Publ. Ltd., No. 260, Dec. 1985.

IBM Tec. Disc. Bulletin, "Wide Wheel-Based Sprocket with Bidirectional Locking Insert for Forms-Feed Mechanisms", vol. 28, No. 9, Feb. 1986, pp. 3816-3817.

*Primary Examiner*—Paul T. Sewell

*Assistant Examiner*—James R. McDaniel

*Attorney, Agent, or Firm*—Frishauf, Holtz, Goodman & Woodward

[57] ABSTRACT

A web feed tractor for a printer which comprises a timing belt having outer web engaging pins and inner teeth, a sprocket wheel drivingly connected to the belt and having belt engaging cogs and a guide portion, a frame rotatably receiving the sprocket and having a guide portion, a web holding plate assembly pivoted to the frame, and a web support plate connected to the frame and having a lock and a lock ring fitted on the lock.

18 Claims, 6 Drawing Sheets

WEB FEED TRACTOR FOR PRINTER

BACKGROUND OF THE INVENTION

This invention relates to improvements of the belt drive mechanism in a web feed tractor for printers and more particularly, to a web feed tractor having means for the prevention of meandering of the endless timing belt in the web feed tractor, whereby the timing belt can be driven properly and positively driven along its endless-track with the pins on the outer surface of the belt in precise alignment with and in proper engagement with the marginal perforations in a web being fed by the web feed tractor whereby the web can be properly fed. Thus, the web feed tractor of the invention can be advantageously employed in printers such as computers, word processors and the like information processing machines.

PRIOR ART

In the conventional web feed tractors for computers, word processors and the like information processing machines, it has been known that an endless timing belt having a plurality of laterally spaced pins in a longitudinal row on the outer surface of the belt is continuously driven along its endless track when a driving sprocket wheel is rotated by a drive means with the pins engaging in the marginal perforations in a web so as to continuously feed the web.

In computers, word processors and the like information processing machines, generally, the web feed tractors each having its associated endless timing belt which is driven by the associated feed tractor are provided in left- and right-hand opposing pairs and thus, one of the most important problems experienced in such web feed mechanisms is how to drive the endless timing belts along their associated endless tracks provided by the web feed tractors. The reason is that if and when one of the timing belts associated with one of the web feed tractors in the opposing pair meanders as the two timing belts are driven along their endless tracks provided by the opposing web feed tractors, an inconsistency in web feed pitch occurs between the opposing web feed tractors and as a result, the distance of one of the timing belts tends to differ from that of the other timing belt with respect to the marginal perforations of the web being fed. In extreme cases, the web is torn, caught in one of the web feed tractors and/or creased.

In order to eliminate the problem, U.S. Pat. No. 3,825,162 proposes an improved web feed mechanism in which the opposite sides of the travelling track of the timing belt are raised to provide vertical shoulders which are adapted to prevent the timing belt from displacing transversely of the track. However, from the relationship of the outer surface of the timing belt to the web feed pins on the belt and the demand for a compact web feed mechanism, it is in fact difficult to provide track shoulders having a substantial height. Furthermore, since the timing belt is required to be trained about the track with a clearance left therebetween, when the belt is driven at high speeds in a high speed printer, the timing belt tends to run on one of the track side shoulders and impedes smooth feed of the web. Such tendency is especially serious when the timing belt has elongated and/or twisted as a result of the use of the belt for a prolonged time period.

SUMMARY OF THE INVENTION

Therefore, an object of the present invention is to provide an improved web feed tractor having means for the prevention of meandering of the endless timing belt which eliminates the drawbacks inherent in the conventional web feed tractors and which can effectively prevent the timing belt from meandering even when the belt is driven along the endless track at extremely high speeds to thereby feed the web positively and precisely.

According to the present invention, a web feed tractor for a printer comprises an endless timing belt having an outer surface with a plurality of web engaging pins projecting outwardly therefrom in at least one longitudinal row, and an inner surface with teeth projecting inwardly therefrom; a frame; a rotatable sprocket wheel coupled to said frame and drivingly engaging said endless timing belt, said sprocket wheel having an outer periphery with at least two circumferential parallel rows of belt engaging means on said outer periphery, said belt engaging means drivingly engaging said teeth of said timing belt; a web holding plate assembly pivotally mounted to said frame, said web holding plate assembly including upper and lower plates resiliently biased towards each other; a web support plate connected to said frame; and said frame and web support plate cooperatively defining a support stage for said timing belt, said support stage engaging said inner surface of said timing belt, at least said support stage and said sprocket wheel defining a track along which said timing belt travels relative to said frame and web support plate. Also provided in accordance with the invention is means for preventing meandering of said timing belt relative to said frame and said sprocket wheel as said timing belt is driven along said track by the rotation of said sprocket wheel, said meandering prevention means comprising guiding ribs provided on one of said inner surface of said timing belt and at least a portion of said track defining means, and a guide groove on the other of said inner surface of said timing belt and said at least a portion of said track defining means, said guiding ribs being engageable in said guide groove during driving of said timing belt to prevent said meandering thereof.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

BRIEF DESCRIPTION OF THE DRAWINGS

The accompanying drawings show two preferred embodiments of the present invention in which.

PREFERRED EMBODIMENTS OF THE INVENTION

Figure 1:
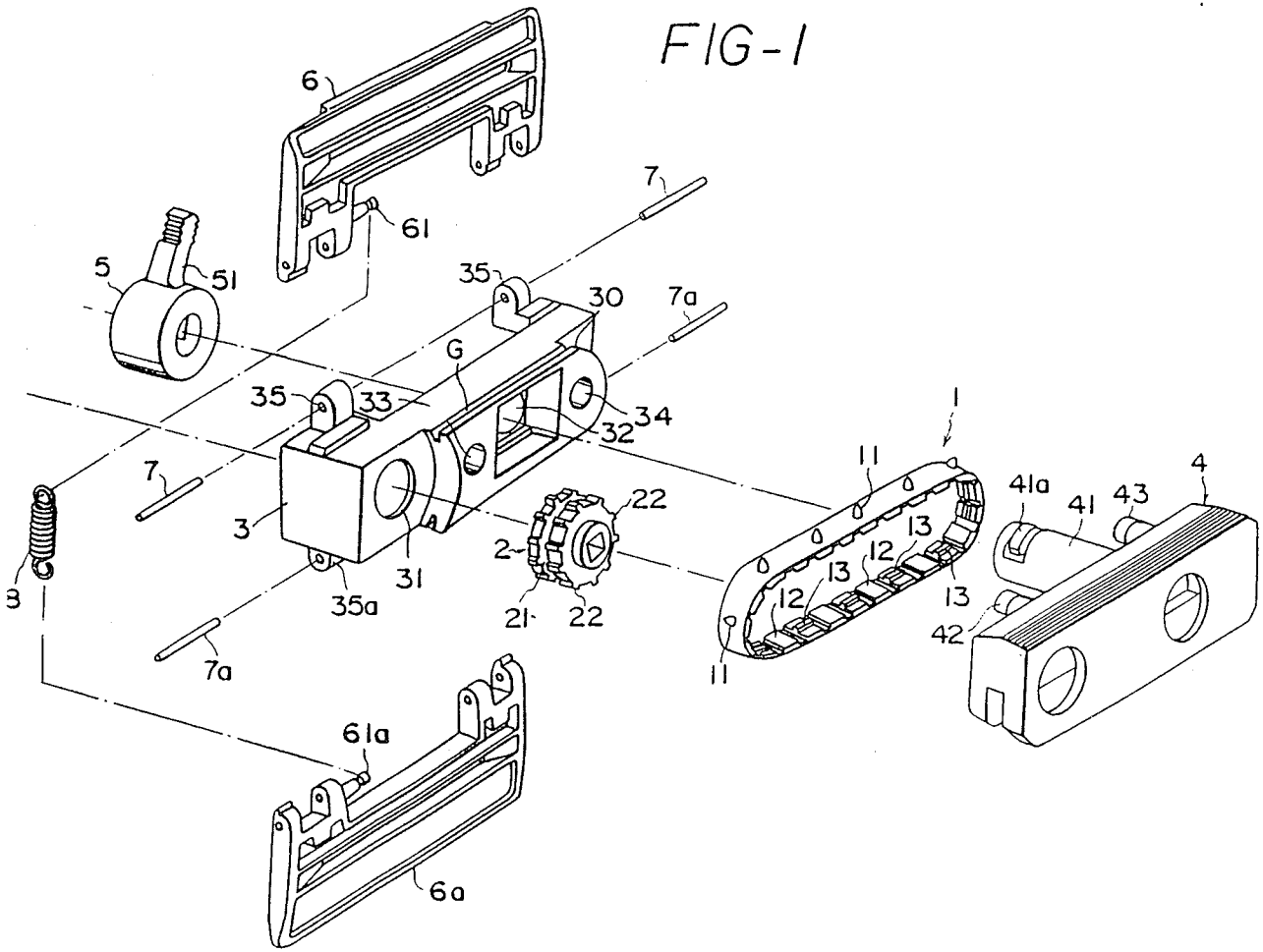
FIG. 1 is an exploded perspective view of the first embodiment of the web feed tractor constructed in accordance with the principle of the present invention.
Figure 2:
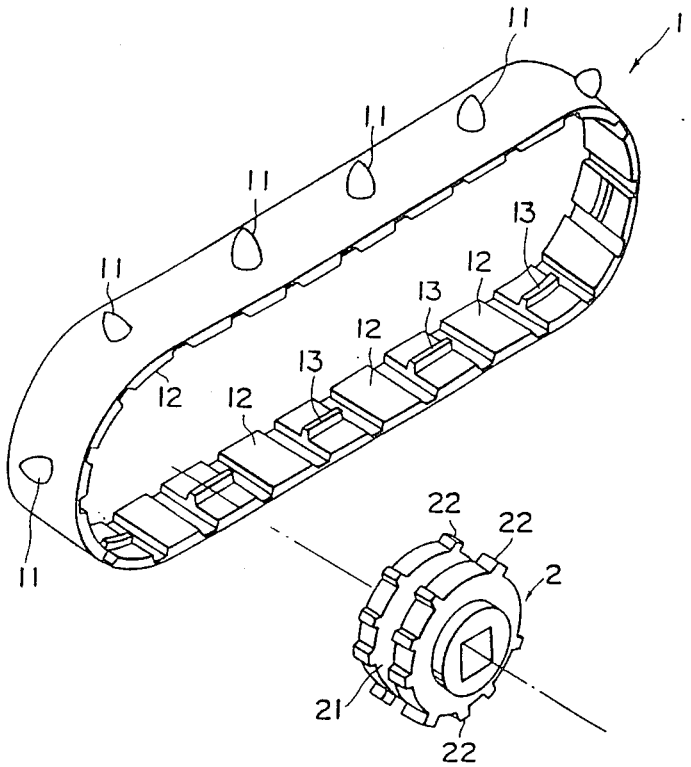
FIG. 2 is a fragmentary exploded perspective view on an enlarged scale of the timing belt and sprocket wheel employed in the web feed tractor shown in FIG. 1.
Figure 3:
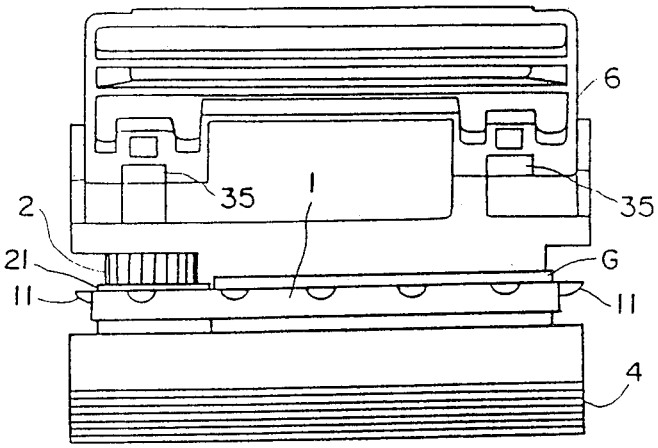
FIG. 3 is a top plan view on an enlarged scale of the web feed tractor of FIG. 1 in its assembled position with a portion of the timing belt cut away to show the peripheral guide groove in the sprocket wheel and the guide groove in the frame.
Figure 4:
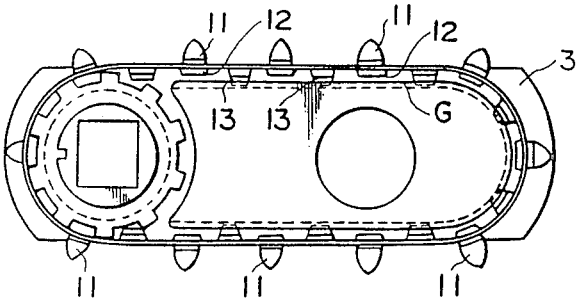
FIG. 4 is a side elevational view on an enlarged scale of the web feed tractor of FIG. 1 showing the endless track of the timing belt.

The present invention will be now described referring to the accompanying drawings and more particularly, to FIGS. 1 to 5 inclusive thereof in which the first embodiment of the web feed tractor constructed in accordance with the present invention adapted to be used with printers in shown.

Reference numeral 1 generally denotes an endless timing belt having a longitudinal row of feed pins 11,11, . . . projecting outwardly from the outer surface of the belt in an equally spaced relationship. The pins 11 are adapted to engage in the perforations at the marginal edges of a web (not shown) to be fed by the timing belt 1. The timing belt 1 is also provided on the inner surface thereof with a longitudinal row of teeth 12, 12 . . . projecting inwardly from the inner surface of the belt in the same pitch as that of the teeth on a sprocket wheel of which description will be made hereinafter. Trace or guiding ribs 13, 13 . . . project inwardly from alternate teeth 12, 12 . . . and extend transversely of the associated teeth.

Reference numeral 2 generally denotes a sprocket wheel. The central area of the periphery of the sprocket wheel 2 is provided with a circular peripheral guide groove 21 along which the trace or guiding ribs 13 slide. A plurality of equally spaced cogs 22, 22, . . . project outwardly in two parallel longitudinal rows at the opposite marginal edges of the periphery of the sprocket wheel 2 on the opposite sides of the peripheral groove 21. A sprocket wheel to be used for this invention can be modified to the bobbin type, when it is needed.

Reference numeral 3 generally denotes a frame which has a transverse through hole 31 at one end of the frame for rotatably mounting the sprocket wheel 2 therein. The sprocket wheel 2 is rotated as a drive shaft (not shown) operatively connected to the sprocket wheel rotates. A stage 30 projects outwardly from one side of the frame 3 and is provided in the periphery thereof with an endless guide groove G which is complementary to (i.e., in alignment with) the peripheral guide groove 21 in the sprocket wheel 2 to complete the track of the endless timing belt 1.

The frame 3 is further provided with three laterally spaced transverse holes 32, 33 and 34. The transverse hole 32 is positioned between the two other transverse holes 33, 34 and terminates short of the stage 30 whereas the transverse holes 33, 34 extend through the stage 30.

Reference numeral 4 generally denotes a web support plate which is inclined at its inside edge. A horizontal lock pipe or projection 41 extends inwardly from the side of the support plate 4 facing the frame 3 in the center of the plate 4 and is received in the center transverse hole 32 in the frame 3. Sorter horizontal pipes or projections 42 and 43 extend inwardly from the abovementioned side of the plate 4 on the opposite sides of the pipe or projection 41 and are received in the transverse holes 33 and 34 in the frame 3, respectively, whereby the web support plate 4 is integrally connected to the frame 3. When the frame 3 and plate 4 are connected, the width of the timing belt has an allowance for the distance between the frame 3 and the web support plate 4. The center lock pipe or projection 41 is provided in a portion of the periphery thereof with a resilient fastening tongue 41*a*. The center lock pipe 41 has such a length that the resilient fastening tongue 41*a* projects from the side of the frame 3 opposite from the stage 30 when the web feed tractor is assembled.

Reference numeral 5 generally denotes a lock ring adapted to fit on the resilient fastening tongue 41*a* of the center or longer lock pipe 41 on the web support plate 4. Lock rings has an operation handle 51 extending radially outwardly from the periphery of the ring. When the lock ring 5 is rotated in one direction by means of the handle 51, the ring exerts a centripetal force on the fastening tongue 41*a* on the center lock pipe 41 whereby a support shaft (not shown) received in the lock ring is locked to the center lock pipe 41. When the lock ring 5 is rotated in the opposite direction, the ring releases the fastening tongue 41*a* which in turn flexes outwardly whereby the support shaft is unlocked.

Reference numerals 6 and 6*a* denote upper and lower web holding plates being inclined at their free edges and which are pivotably mounted on the frame 3 by means of knuckle means. The knuckle means comprises laterally spaced upper ears 35, 35 on the upper surface of the frame, laterally spaced lower ears 35*a*, 35*a* (only one of the lower ears is shown in FIG. 1) on the bottom of the frame, upper pivot pins 7, 7 extending through the upper ears 35, 35 and lower pivot pins 7*a*, 7*a* extrending through the lower ears 35*a*, 35*a*. The upper and lower web holding plates 6, 6*a* are identical except that they are inversely disposed. Bosses 61, 61*a* project inwardly from the upper and lower web holding plates 6, 6*a*, respectively, at areas adjacent to the pivot mounting points of the plates on the frame 3. A coil spring 8 is anchored at the opposite ends thereof to the bosses 61, 61*a* so as to bias the two web support plates towards each other whereby the support plates are allowed to pivot resiliently.

Figure 5:
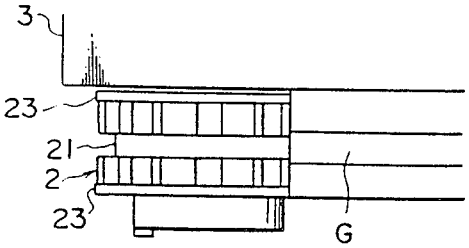
FIG. 5 is a fragmentary top plan view on an enlarged scale of the modified sprocket wheel having the flanges at the marginal edges thereof and adapted to be incorporated in the web feed tractor of FIG. 1.

Referring now to FIG. 5, there is shown a modified sprocket wheel and frame assembly which is substantially similar to the embodiment of the assembly described hereinabove and illustrated in FIG. 1 except that the sprocket wheel 2 is provided at the marginal edges with circular flanges 23, 23. Although not shown, according to the present invention, it is also possible that the trace ribs 13 are arranged in two or three parallel rows on the inner surface of the endless timing belt 1 and the sprocket wheel 2 and the frame 3 are also provided with a plurality of parallel peripheral grooves 21 and a plurality of parallel guide grooves G corresponding to the number of rows of the trace ribs 13, respectively. Furthermore, when the web feed tractor incorporates a follower sprocket wheel (not shown) therein, the follower sprocket wheel is also provided with a peripheral groove or grooves. Such alterations are, of course, within the scope of the present invention as defined in the appended claims.

As clear from the foregoing description of the first embodiment of the web feed tractor according to the present invention, since the inner surface of the endless timing belt 1 is provided with a single or plural rows or trace ribs 13, 13, . . . arranged in the longitudinal direction of the belt 1, the sprocket wheel 2 is provided on its periphery with a peripheral guide groove or grooves 21 along which the trace ribs travel and the stage 30 on the frame 3 is provided with a guide groove or grooves G which are complementary to the peripheral groove or grooves 21 to complete the track along which the timing belt travels and as the timing belt 1 travels along the guide track formed by the peripheral guide 21 and guide groove G in the sprocket wheel 2 and frame 3, respectively, any transverse displacement of the timing belt 1 is controlled by the peripheral guide and guide grooves 21, G in the sprocket wheel 2, frame 3, respectively. Thus, even when the timing belt 1 is drive at extremely high speeds, the belt can be positively prevented from meandering. Furthermore, unless the timing belt 2 breaks due to wear or fatigue, the timing belt 1 would not meander even after the use of the belt for a prolonged time period as experienced in the conventional web feed tractors.

Figure 6:
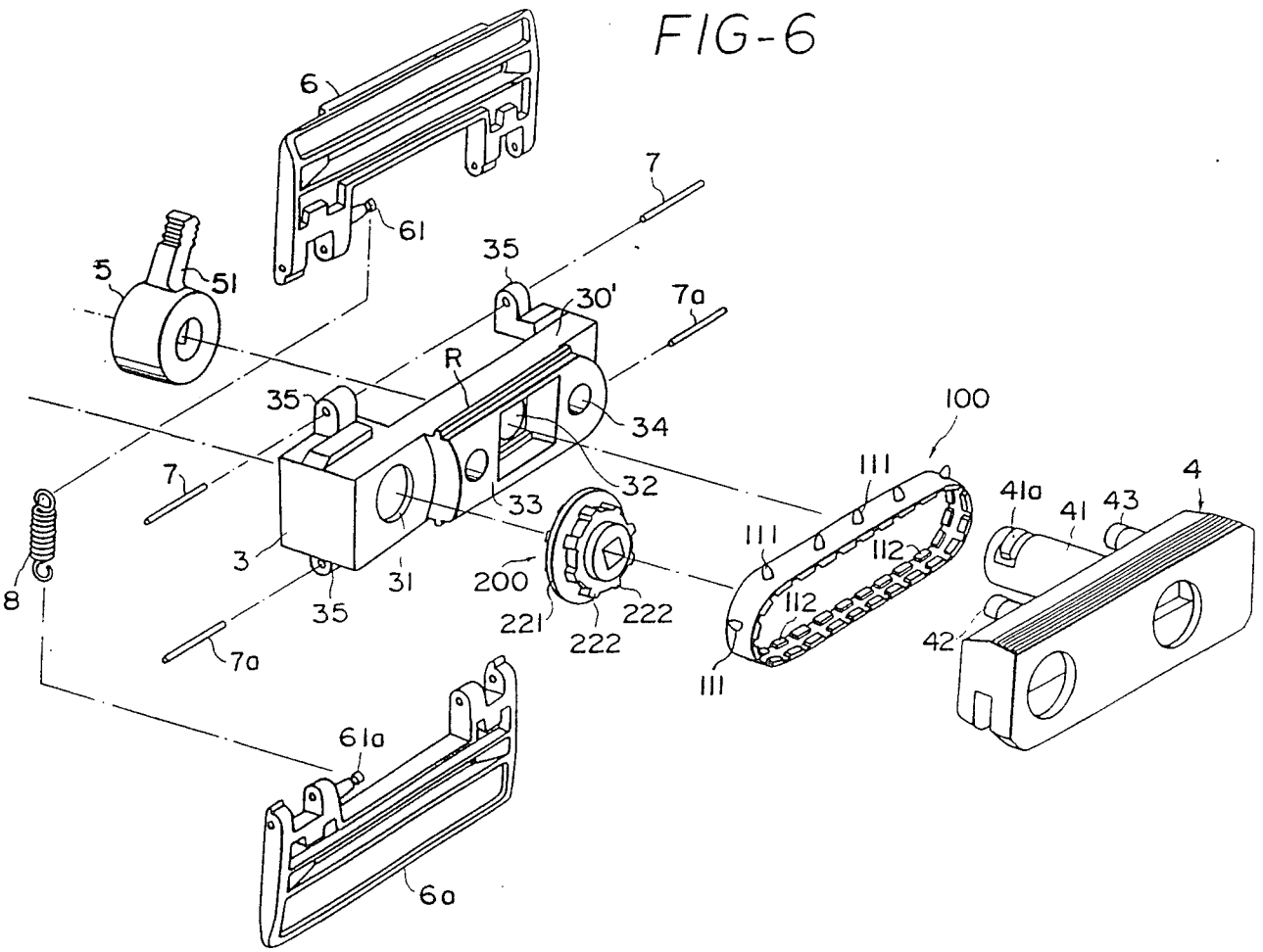
FIG. 6 is an exploded perspective view of the second embodiment of the web feed tractor constructed in accordance with the principle of the present invention.
Figure 7:
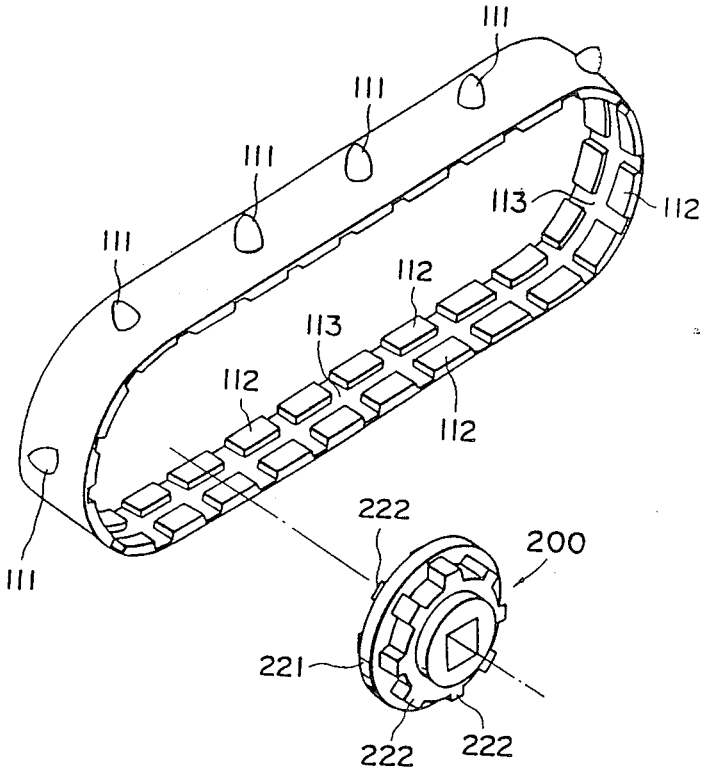
FIG. 7 is a fragmentary perspective view on an enlarged scale of the timing belt and sprocket wheel employed in the web feed tractor shown in FIG. 6.
Figure 8:
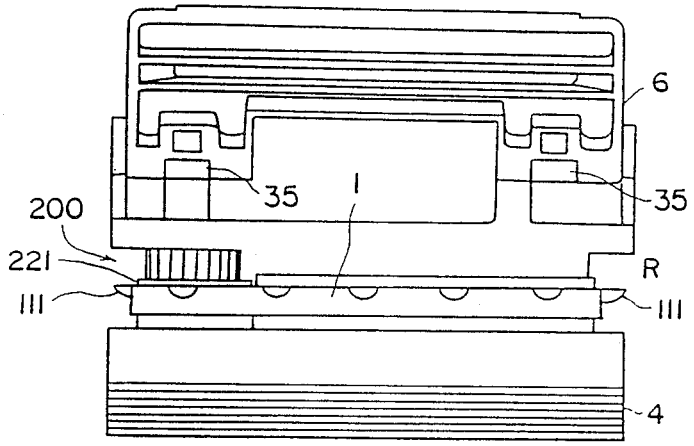
FIG. 8. is a top plan view on an enlarged scale of the web feed tractor of FIG. 6 in its assembled position with a portion of the timing belt cut away to show the guide flange on the sprocket wheel and the guide rib on the stage of the frame.

FIGS. 6 to 8 inclusive illustrate a second embodiment of the web feed tractor constructed in accordance with the present invention. The second embodiment is substantially similar to the first embodiment except that a modified timing belt, sprocket wheel and frame are incorporated in the second embodiment. Thus, description will be made of only the modified endless timing belt, sprocket wheel and frame referring to FIGS. 6 to 8 inclusive. The modified endless timing belt is generally shown by reference numeral 100 and has a row of feed pins 111, 111, . . . projecting outwardly from the outer surface of the belt in an equally spaced relationship in the longitudinal direction of the same. As described in connection with the endless timing belt 1 of the first embodiment, the pins 111 are adapted to engage in the perforations at the marginal edges of a web (not shown) to be fed by the timing belt 111. The endless timing belt 111 is also provided on the inner surface thereof with teeth 112, 112 . . . arranged in two parallel rows in the longitudinal direction of the belt. The teeth 112 in each of the longitudinal rows are laterally spaced in the same pitch as that of the teeth on the modified sprocket wheel of which description will be made hereinafter. The parallel rows of the teeth 112 define an endless riding groove 113 (see FIG. 7) extending in the longitudinal direction of the belt therebetween.

The modified sprocket is generally shown by reference numeral 200 and has a circular peripheral flange 221 in the center of the periphery of the wheel. The riding groove 113 rides on and slides along the center peripheral flange 221. The sprocket wheel 200 further has cogs 222, 222 in circumferentially spaced relationship on the opposite sides thereof embracing the center flange 221 therebetween. The modified frame 3 is provided on one side thereof with the modified stage 30' provided on the periphery thereof with an endless guide ridge R which is complementary to (i.e., in alignment with) the peripheral flange 221 on the sprocket wheel 200 to complete the track of the endless belt 100.

The construction and arrangement of the other components of the second embodiment of the web feed tractor of the invention are the same as those of the corresponding components of the first embodiment of the web feed tractor and thus, description of the other components will be omitted herein.

As clear from the foregoing description of the second embodiment of the web feed tractor of the present invention, since the endless timing belt 100 is provided on the inner surface thereof with the riding groove 113, the sprocket wheel 200 is provided on the periphery thereof with the guide flange 221 on which the riding groove 113 slide and the stage 30' on the frame 3 is provided with the guide rib R whereby the guide flange 221 and guide rib R positively control the riding groove 113 against any transverse displacement even when the timing belt 100 is driven at extremely high speeds, the timing belt is prevented from meandering. Furthermore, unless the timing belt 100 breaks due to wear or fatigue after use for a prolonged time period, the timing belt would not meander as experienced in the conventional web feed tractors.

Thus, the web feed tractor of the present invention can effectively prevent the meandering of the timing belt and since the web feed tractor of the invention is simple in construction and less expensive, the present invention will greatly contribute in the art to which the present invention pertains.

While two illustrative embodiments of the invention have been shown and described in detail, it will be appreciated that variations and modifications thereof within the scope of the invention will undoubtedly suggest themselves to those skilled in the art. Accordingly, the foregoing description and showing should be taken merely as illustration and not in any limiting sense.

What is claimed is:

1. A web feed tractor for a printer, comprising:

an endless timing belt having an outer surface with a plurality of web engaging pins projecting outwardly therefrom in at least one longitudinal row, and an inner surface with drive teeth projecting inwardly therefrom;

a frame;

a rotatable sprocket wheel coupled to said frame and drivingly engaging said endless timing belt, said sprocket wheel having an outer periphery with at least two circumferential parallel rows of belt engaging means on said outer periphery, said belt engaging means drivingly engaging said drive teeth of said timing belt;

a web holding plate assembly pivotally mounted to said frame, said web holding plate assembly including upper and lower plates resiliently biased towards each other;

a web support plate connected to said frame;

said frame and web support plate cooperatively defining a support stage for said timing belt, said support stage engaging said inner surface of said timing belt, at least said support stage and said sprocket wheel defining a track along which said timing belt travels relative to said frame and web support plate; and meandering prevention means, in addition to said driving teeth of said timing belt and said belt engaging means of said sprocket wheel, for preventing meandering of said timing belt relative to said frame and said sprocket wheel as said timing belt is driven along said track by the rotation of said sprocket wheel, said meandering prevention means comprising guiding ribs provided on one of said inner surface of said timing belt and at least a portion of said track defining means, and a guide groove on the other of said inner surface of said timing belt and said at least a portion of said track defining means, said guiding ribs being engageable in said guide groove during driving of said timing belt, said guide groove being dimensioned to receive said guiding ribs therein to substantially prevent sidewise movement of said guiding ribs during driving of said timing belt to thereby prevent said meandering of said timing belt.

2. The web feed tractor of claim 1, wherein said teeth on said inner surface of said timing belt are arranged in a single row in the longitudinal direction of said timing belt.

3. The web feed tractor of claim 1, wherein:

a plurality of said timing belt teeth have said guiding ribs thereon;

said sprocket wheel has a circular guide groove between said at least two rows of belt engaging means for guiding said guiding ribs of said timing belt; and said frame has said support stage projecting outwardly from one side thereof, said support stage having a guide groove therein along which said guiding ribs of said timing belt are guidingly engaged, said circular guide groove in said sprocket wheel and said guide groove in said support stage being in alignment with each other.

4. The web feed tractor of claim 3, wherein alternate ones of said timing belt teeth have said guiding ribs thereon.

5. The web feed tractor of claim 3, comprising lock means for locking said web support plate to said frame.

6. The web feed tractor of claim 5, wherein said lock means includes a lock ring having an operating handle.

7. The web feed tractor of claim 6, wherein said lock means further comprises:

a lock projection extending from one side of said web support plate into and through an opening in said frame and stage; and a resilient fastening tongue on said lock projection for locking onto a shaft or the like;

said lock ring being engageable with said lock projection to engage said tongue to press said tongue lockingly onto said shaft or the like upon operation of said operating handle.

8. The web feed tractor of claim 1, comprising lock means for locking said web support plate to said frame.

9. The web feed tractor of claim 8, wherein said lock means includes a lock ring having an operating handle.

10. The web feed tractor of claim 9, wherein said lock means further comprises:

a lock projection extending from one side of said web support plate into and through an opening in said frame and stage; and a resilient fastening tongue on said lock projection for locking onto a shaft or the like;

said lock ring being engageable with said lock projection to engage said tongue to press said tongue lockingly onto said shaft or the like upon operation of said operating handle.

11. The web tractor of claim 1, wherein said web support plate has an inwardly and downwardly inclined inner portion adjacent a longitudinal edge of said timing belt for further guiding said timing belt.

12. The web feed tractor of claim 3, wherein said web support plate has an inwardly and downwardly inclined inner portion adjacent a longitudinal edge of said timing belt for further guiding said timing belt.

13. The web feed tractor of claim 1, wherein:

a plurality of said timing belt teeth have said guide groove formed therein;

said sprocket wheel has a circular guide rib projecting between said at least two rows of belt engaging means for engaging said guide grooves for guiding said guiding ribs of said timing belt; and said frame has said support stage projecting outwardly from one side thereof, said support stage having a guide rib projecting therefrom for engaging said guide grooves and along which said guide grooves of said timing belt travel, said circular guide rib of said sprocket wheel and said guide rib of said support stage being in alignment with each other.

14. The web feed tractor of claim 13, wherein each of said timing belt teeth have said guiding groove formed therein.

15. The web feed tractor of claim 13, comprising lock means for locking said web support plate to said frame.

16. The web feed tractor of claim 15, wherein said lock means includes a lock ring having an operating handle.

17. The web feed tractor of claim 16, wherein said lock means further comprises:

a lock projection extending from one side of said web support plate into and through an opening in said frame and stage; and a resilient fastening tongue on said lock projection for locking onto a shaft or the like;

said lock ring being engageable with said lock projection to engage said tongue to press said tongue lockingly onto said shaft or the like upon operation of said operating handle.

18. The web feed tractor of claim 13, wherein said web support plate has an inwardly and downwardly inclined inner portion adjacent a longitudinal edge of said timing belt for further guiding said timing belt.

* * * * *